US010238558B2

(12) United States Patent
Kramer

(10) Patent No.: US 10,238,558 B2
(45) Date of Patent: Mar. 26, 2019

(54) BACKREST ASSEMBLY FOR WHEELCHAIR WITH RECLINING SEAT

(71) Applicant: Sunrise Medical GmbH, Malsch (DE)

(72) Inventor: Markus Kramer, Bammental (DE)

(73) Assignee: Sunrise Medical GmbH, Malsch (DE)

( * ) Notice: Subject to any disclaimer, the term of this patent is extended or adjusted under 35 U.S.C. 154(b) by 0 days.

(21) Appl. No.: 15/312,735

(22) PCT Filed: May 18, 2015

(86) PCT No.: PCT/IB2015/053651
§ 371 (c)(1),
(2) Date: Nov. 21, 2016

(87) PCT Pub. No.: WO2015/177709
PCT Pub. Date: Nov. 26, 2015

(65) Prior Publication Data

US 2017/0095384 A1 Apr. 6, 2017

(30) Foreign Application Priority Data

May 19, 2014 (EP) ..... 14168876

(51) Int. Cl.
*A61G 5/00* (2006.01)
*A61G 5/10* (2006.01)
*A61G 5/12* (2006.01)

(52) U.S. Cl.
CPC ..... *A61G 5/1067* (2013.01); *A61G 5/1048* (2016.11); *A61G 5/12* (2013.01); *A61G 5/125* (2016.11); *A61G 2203/74* (2013.01)

(58) Field of Classification Search
None
See application file for complete search history.

(56) References Cited

U.S. PATENT DOCUMENTS 4,655,471 A 4/1987 Peek
6,425,635 B1 7/2002 Pulver
(Continued)

FOREIGN PATENT DOCUMENTS

EP 0841053 A2 5/1998
WO WO-2012044950 A1 * 4/2012 ..... A61G 5/1067

OTHER PUBLICATIONS

Notice of Opposition of European Patent No. 2946758B1, paper dated Oct. 27, 2017.
(Continued)

*Primary Examiner* — Paul N Dickson
*Assistant Examiner* — Hilary L Johns
(74) *Attorney, Agent, or Firm* — MacMillan, Sobanski & Todd, LLC

(57) ABSTRACT

The invention relates to a backrest assembly for a wheelchair with a backrest frame pivotally connected to a seat or seat frame, a carrying means provided by or attached to the backrest frame, a rotating means rotatable secured to the carrier means, a first sliding means slidable connected to the backrest frame on the rear side of the backrest assembly and connected to the rotating means via a first mechanical link, a second sliding means slidable secured to the backrest frame on the front of the backrest assembly and connected to the rotating means via a second mechanical link, and an actuator for adjusting the backrest assembly between an upright and reclined position with the actuator being connected to the first sliding means for driving the second sliding means via the rotating means to perform a sinusoidal movement.

17 Claims, 8 Drawing Sheets

(56) References Cited

U.S. PATENT DOCUMENTS

| | | | | |
|---|---|---|---|---|
| 2004/0094936 | A1* | 5/2004 | Koerlin | A61G 5/006<br>280/650 |
| 2005/0088024 | A1* | 4/2005 | Rozaieski | A61G 5/1067<br>297/362.12 |
| 2012/0080919 | A1* | 4/2012 | Engman | A61G 5/1067<br>297/354.12 |

OTHER PUBLICATIONS

WO 2015/177709 International Preliminary Report on Patentability and Written Opinion of the International Searching Authority, dated Nov. 22, 2016.

* cited by examiner

BACKREST ASSEMBLY FOR WHEELCHAIR WITH RECLINING SEAT

CROSS-REFERENCE TO RELATED APPLICATIONS

This application is the National Phase of International Application PCT/IB2015/053651 filed May 18, 2015 which designated the U.S. and that International Application was published in English under PCT Article 21(2) on Nov. 26, 2015 as International Publication Number WO 2015/177709 A1. PCT/IB2015/053651 claims priority to European Patent Application No. 14168876.2, filed May 19, 2014. Thus, the subject nonprovisional application claims priority to European Patent Application No. 14168876.2, filed May 19, 2014. The disclosures of both applications are incorporated herein by reference in their entirety.

BACKGROUND OF THE INVENTION

The invention refers to a backrest assembly for a wheelchair with a reclining seat.

A wheelchair having a primary articulated member, at least one secondary articulated member, a primary sensor for detecting the position of the primary member, a secondary sensor for detecting the position of the secondary member, and a controller capable of articulating the secondary articulated member as a function of the movement of the primary articulated member, is known from US 2004/094936.

US 2005/0088024 discloses a reclining seat which includes a base, a back frame and back support connected to the back frame for translation relative to the back frame. In a first embodiment, a mechanism is described to couple the back frame to the back support such that rotation of the back frame relative to the base automatically translates the back support relative to the back frame. In a second embodiment, a mechanism is described to allow a user to control movement of the back support independently of back frame rotation. Said reclining seat can be incorporated into a wheelchair.

A backrest assembly for a wheelchair is known from US 2012/0080919 (EP 2 621 445 A1) which includes a support plate pivotally connected to a seat, wherein the support plate is configured to be pivotally adjusted between upright and reclined positions with respect to the seat; a slide plate slidably secured on a front surface of the support plate; and a backrest adjustment assembly operatively connected to the support plate and the slide plate. The backrest adjustment assembly includes a link configured to adjust the support plate. The slide plate slides over the support plate through the link.

In general a backrest assembly of a wheelchair has a pivot point of a rotational movement of a backrest frame relative to a seat frame during adjustment of the backrest assembly between an upright position and a reclined position. In case said pivot point is not concentric with the hip rotation point of a user of the wheelchair, shear forces will be caused during said adjustment between the backrest assembly, in particular a cushion of the backrest assembly, and the back of the user. In order to compensate said shear forces backrest assemblies have been developed with a support plate pivotally connected to a seat and a slide plate slidably secured on a front surface of the support plate, as described in US 2012/0080919 (EP 2 621 445 A1). In the prior art the link between the slide plate and the support plate is configured to adjust the slide plate with respect to the support plate by connecting a post to a drive bar on a rear surface of the support plate, with the drive bar operatively connecting to a pivot arm on the front surface of the support plate, and the pivot arm operatively connecting to the slide plate via a knob sliding through a slot within the slide plate such that movement of the pivot arm causes the slide plate to slide over the support plate. A recline angle between the backrest and the seat of the known wheelchair thus is determining the rotation of the pivot arm which in turn causes the sliding of the sliding plate via the knob. The effect of the recline angle of the known backrest assembly on the movement of the slide plate is not adjustable.

Thus it would be desirable to provide a backrest assembly for a wheelchair with a reclining seat overcoming the disadvantages known in the state of the art, especially allowing an adjustable compensation of shear forces.

SUMMARY OF THE INVENTION

The invention provides a backrest assembly for a wheelchair with a backrest frame pivotally connected to a seat or seat frame, a carrying means provided by or attached to the backrest frame, a rotating means rotatable secured to the carrier means, a first sliding means slidable connected to the backrest frame on the rear side of the backrest assembly and connected to the rotating means via a first mechanical link, a second sliding means slidable secured to the backrest frame on the front of the backrest assembly and connected to the rotating means via a second mechanical link, and an actuator for adjusting the backrest assembly between an upright and reclined position with a recline angle, with the actuator being connected to the first sliding means for driving the second sliding means via the rotating means to perform a sinusoidal movement.

A preferred embodiment is characterized in that the first mechanical link comprises a first driving cam sliding within at least one first control slot, and/or second mechanical link comprises a second driving cam sliding within at least one second control slot.

It is proposed that the first and/or second driving cam is attachable at different positions, and/or the first and/or second control slot has a predefined path, preferably with a slope and/or a curvature.

With the invention it is also proposed that the sinusoidal movement is adjusted or adjustable via the position of the first and/or second driving cam and/or the path of the first and/or second control slot.

It is advantageous that the backrest frame comprises at least a first rail for slidable engagement of the first sliding means and at least a second rail for slidable engagement of the second sliding means, and/or the backrest frame comprises two parallel first bars, preferably each being provided with one first and one second rail, in particular by having a T shaped cross section or two opposing recesses at each of two opposite edges, and/or two parallel second bars between the two first bars.

It is preferred that the carrying means is provided within the space defined by the backrest frame, and/or the carrying means is arranged between the two first bars, preferably extending between the two second bars, or the carrying means comprises at least a first rail for slidable engagement of the first sliding means and at least a second rail for slidable engagement of the second sliding means.

Some embodiments of the invention are characterized in that the rotating means is arranged on the rear side of the backrest frame, and the rotating means has a first section provided with the first control slot and a second section provided with the second driving cam, preferably the two sections having a relative angular displacement of at least 90°, and/or the rotating means provides the first slot extending substantially radially, and/or the rotating means provides a plurality of positions for the attachment of the second driving cam.

Alternative embodiments of the invention are characterized in that the rotating means is arranged on the front side of the backrest frame, and the carrying means leaves free space relative to the backrest frame or is provided with a first first control slot, preferably the first first slot extending substantially vertical in the upright position of the backrest assembly, and the rotating means has a first section provided with a first second control slot and a second section provided with the second driving cam, preferably the two sections having a relative angular displacement of at least 90°, and/or the rotating means provides the first second slot extending substantially radially, and/or the rotating means provides a plurality of positions for the attachment of the second driving cam.

Still further it is preferred that the first sliding means houses at least a part of the actuator, and/or the first sliding means moves together with the actuator, and/or the first sliding means is pivotally connected to at least one push rod being fixedly connected to the seat or seat frame, and/or the first sliding means is provided with the first driving cam.

Embodiments of the invention are characterized in that the actuator driving the sliding movement of the first sliding means, which is pivotally connected to the push rod being fixedly connected to the seat or seat frame, causes the reclining movement of the backrest frame relative to the seat or seat frame.

It is proposed in line with the invention that the second sliding means has a plate form, and/or the second sliding means is provided with the second control slot, the second control slot preferably extending parallel to or at least partly sloped and/or curved relative to a horizontal line in the upright position of the backrest assembly, and/or the second sliding means carries at least one cushion and/or accessory on the front of the backrest assembly.

Also proposed is that the actuator extends at least partly between the first sliding means and the rotating means or the backrest frame, and/or the actuator comprises a linear drive.

In line with the invention it is advantageous that a radial displacement of the second driving cam affects the total stroke applied to the second sliding means, and/or an angular displacement of the second driving cam affects the starting point of the sinusoidal movement.

With the invention it is also proposed that a negative slope of the second control slot relative to a horizontal line in the upright position of the backrest assembly amplifies the sinusoidal movement, and/or a positive slope of the second control slot relative to a horizontal line in the upright position of the backrest assembly levels the sinusoidal movement.

It is preferred that the rotating means, the first sliding means and/or the second sliding means, preferably the second sliding means, is selectable from a plurality of such means for selecting the movement of the second sliding means during an adjustment of the backrest assembly between the upright and the reclined position.

The invention also refers to a wheelchair comprising a seat, at least two drive wheels and a backrest assembly according to the invention, with the recline angle being controllable from at least 90° to 180°, preferably from 85° to 180°.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1A:
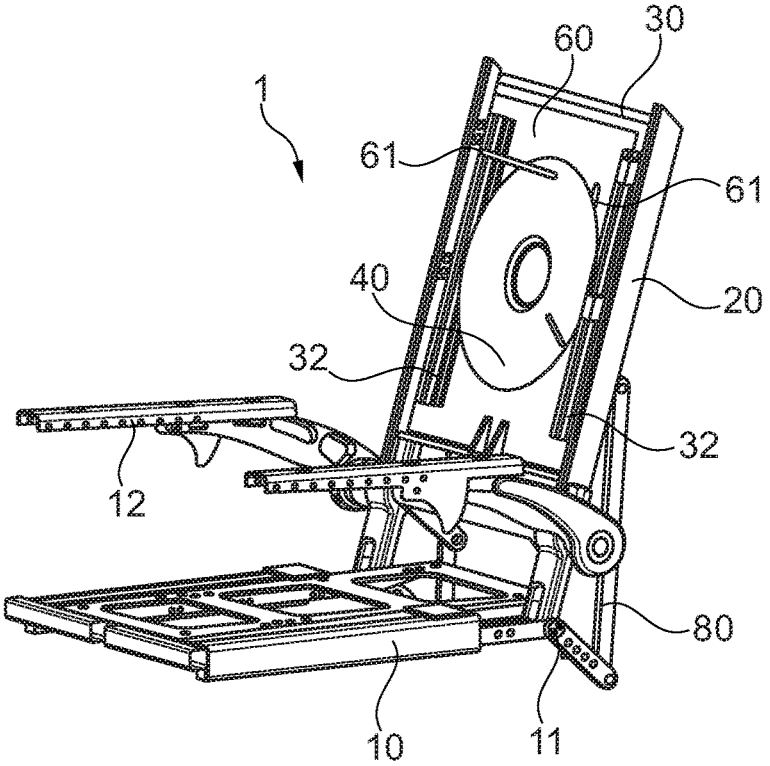
FIG. 1*a* shows a front perspective view of a first embodiment of a backrest assembly of the invention.
Figure 1B:
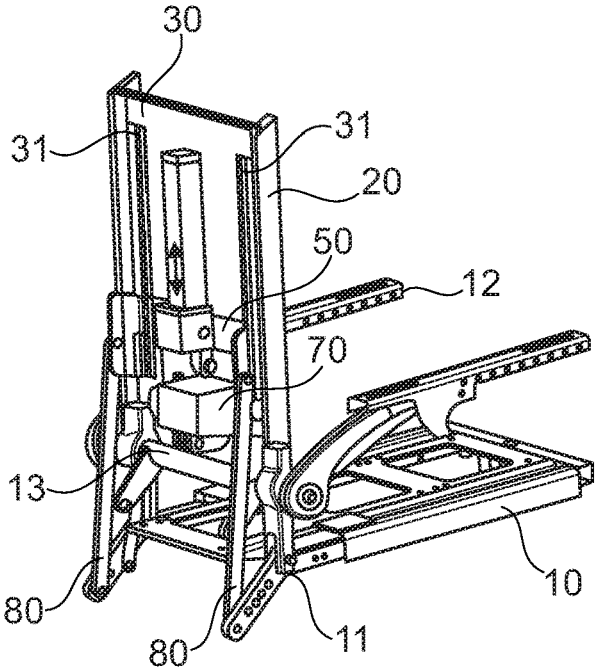
FIG. 1*b* shows a rear perspective view of the backrest assembly of FIG. 1*a;*

FIGS. 1*a* and 1*b* depict a backrest assembly according to a first embodiment of the invention. Such a backrest assembly 1 comprises a seat frame 10 with a pivot point 11 and in connection with two arm rests 12 connected via an armrest axle 13. A backrest frame 20 is connected to the seat frame 10 such that it can be rotated or rather pivoted around the pivot point 11 to adjust the backrest assembly 1 between and upright position and a reclined position. In the upright position the recline angle between the seat frame 10 and the backrest frame 20 is around 90°, but can also be 85°, whereas in the reclined position the recline angle is around 180°.

The backrest frame 20 is connected with a carrying means 30 having first rails 31 attached to its rear side and second rails 32 attached to its front side. A rotating means 40 is rotatably connected to the carrying means 30 on the front side thereof. A first sliding means 50 is slidably attached to the carrying means 30 via the first rails 31 and a second sliding means 60 is attached to the carrying means 30 via the second rails 32, with the rotating means 40 being arranged between the second sliding means 60 and the carrying means 30. An actuator 70 is arranged between the first sliding means 50 and the carrying means 30, with the actuator 70 comprising a linear drive like a linear motor and being fixedly secured to the first sliding means 50 in order to slide the first sliding means 50 relative to the carrying means 30 as well as the backrest frame 20. The first sliding means 50 has the form of a bridge. Push rods 80 are connected at one end thereof with the first sliding means 50 and at the other end thereof to the seat frame 10 such that the actuator 70 affects a rotation of the backrest frame 20 relative to the seat frame 10 around the pivot point 11, with the first sliding means 50 sliding up during reclining of the backrest frame 10 and the second sliding means 60 slide down during such a reclining.

Figure 2:
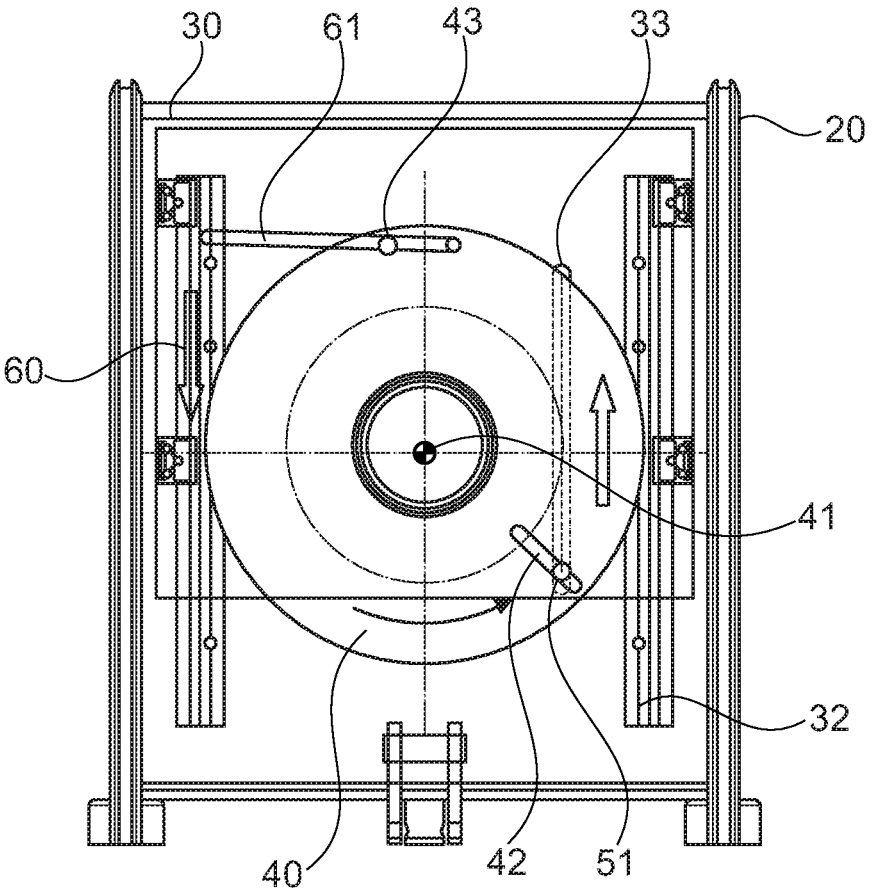
FIG. 2 shows a part view of the front side of the backrest assembly of FIG. 1*a;*

The force transmission between the first sliding means 50 and the second sliding means 60 is achieved via two links, with a first link between the first sliding means 50 and the rotating means 40 and a second link between the rotating means 40 and the second sliding means 60. With respect to FIG. 2 the first and second links are explained in further detail. The first link comprises a first driving cam 51 secured to the first sliding means 50, said first driving cam 51 passing through a first first control slot 33 within the carrying means 30 as well as a first second control slot 42 within the rotating means 40 in order to slide within the respective control slots 33, 42. This first link converts a sliding movement of the first sliding means 50 into a rotational movement of the rotating means 40 rotating around a pivot point 41. As can be seen in FIG. 2 the first first control slot 33 extends substantially parallel to the rails 31, 32, whereas the first second control slot 42 extends radially.

The second link can be best understood with reference to FIG. 2. It comprises a second driving cam 43 fixedly attached to the rotating means 40 and passing through a second control slot 61 provided within the second sliding means 60 for travelling within said second control slot 61. Accordingly, a rotation of the rotating means 40 is converted into a sliding movement of the second sliding means 60 within the second rails 32 relative to the carrying means 30 and the backrest frame 20.

Figure 3A:
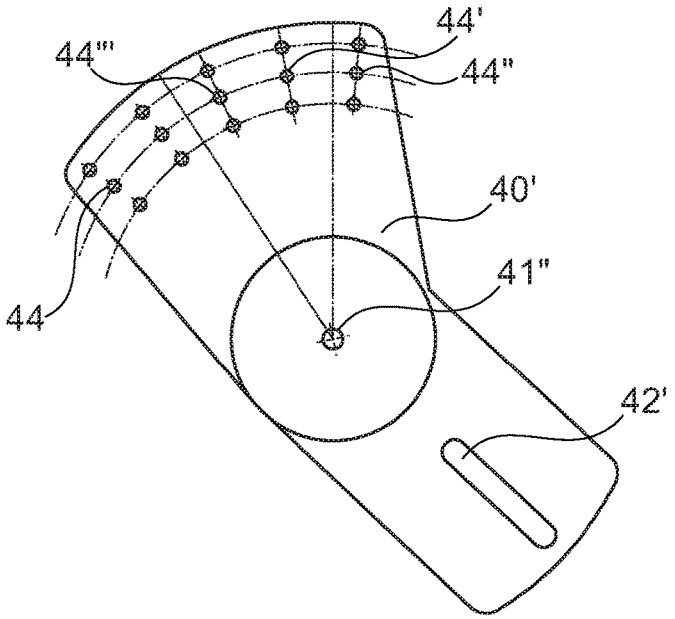
FIG. 3*a* shows a front view of an alternative rotating means of the backrest assembly of FIG. 1*a;*
Figure 3B:
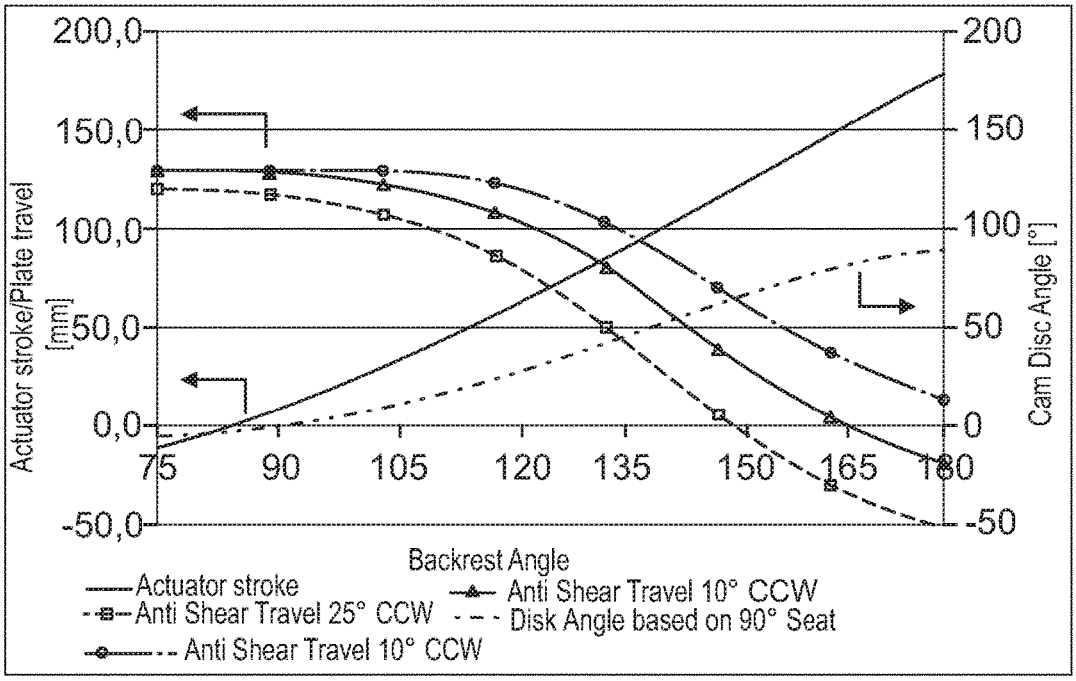
FIG. 3*b* shows 5 graphs explaining a force transmission depending on a recline angle and the placement of a driving cam of the rotating means of FIG. 3*a;*

The movement of the second sliding means 60 is a function of the movement of the first sliding means 50 driven by the actuator 70. The recline angle between the seat frame 10 and the backrest frame 20 is also a function of the first sliding means 50 driven by the actuator. The movement is a sinusoidal movement due to the conversion of the sliding movement of the first sliding means 50 via the rotational movement of the rotating means 40 into the sliding movement of the second sliding means 60. The actuator stroke as a function of the recline angle as well as the rotation angle of the rotating means 40 as function of the recline angle are depicted in FIGS. 3*b* and 3*d*.

By a displacement of at least one of the two driving cams and the arrangement as well as shape of at least one of the control slots the sinusoidal movement is adjustable.

In fact, a radial displacement of the second driving cam 43 affects the total stroke applied to the second sliding means 60 and an angular displacement of the second driving cam 43 affects the starting point of the sinusoidal movement of the second sliding means 60. This is explained in further detail with respect to FIGS. 3*a* and 3*b*. FIG. 3*a* shows an alternative rotating means 40' with its pivot point 41', first second control slot 42' and a plurality of attachment positions 44, 44', 44", 44'". The first second control slot 42' is extending radially. In the following the effect of the position of the second driving cam (not shown) in one of the three attachment positions 44', 44" and 44'", being angularly displaced with respect to each other, is explained with respect to FIG. 3*b*. Said FIG. 3*b* shows the actuator stroke as a function of the backrest angle or better recline angle, the cam disk angle being the rotation angle of the rotating means 40' as a function of the recline angle and the plate travel being the sinusoidal movement of the second sliding means for an attachment of the second driving cam for each one of the three different attachment positions 44', 44", 44'" as a function of the recline angle. A clockwise angular displacement from the attachment position 44' to the attachment position 44" leads to a shift of the starting point of the sinusoidal movement to higher recline angles; whereas a counterclockwise angular displacement from the attachment position 44' to the attachment position 44'" leads to a shift of the sinusoidal movement to smaller recline angles.

Figure 3C:
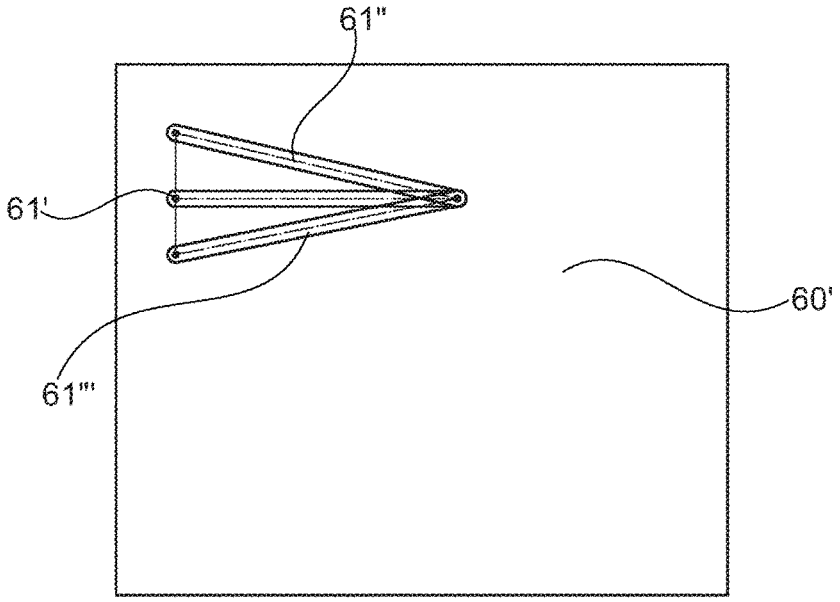
FIG. 3*c* shows a front view of a second sliding means of the backrest assembly of FIG. 1*a;*
Figure 3D:
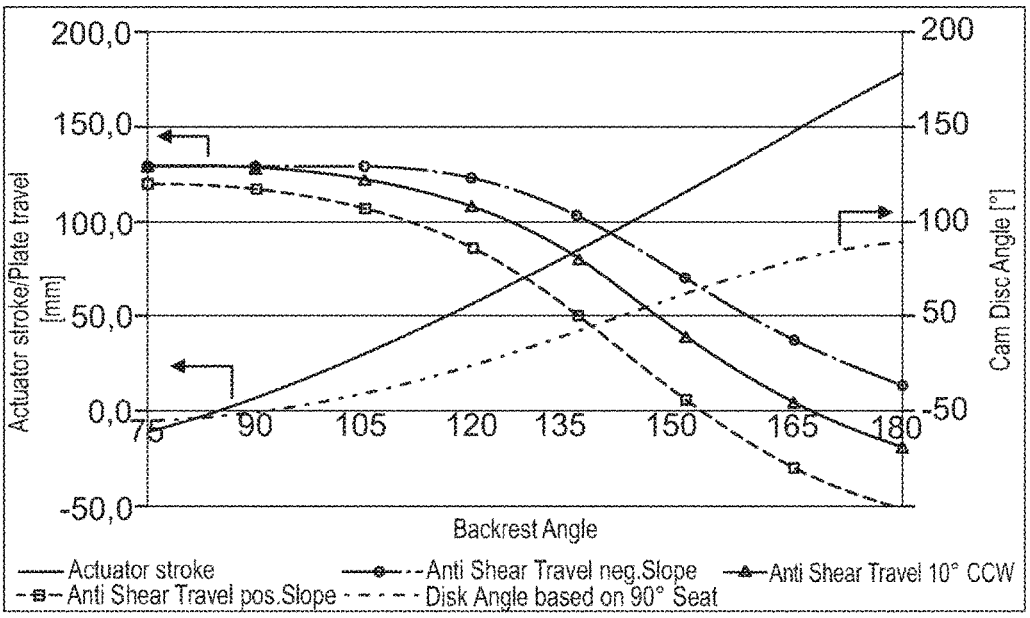
FIG. 3*d* shows 5 graphs explaining a force transmission depending on the recline angle and the slope of a control slot of the second sliding means of FIG. 3*c;*

With respect to FIGS. 3*c* and 3*d* the effect of a slope of the second sliding means is explained. FIG. 3*c* shows an alternative second sliding means 60' with its second control slot 61' and two alternative second control slots, one second control slot 61" with a negative slope and another second control slot 61'" with a positive slope. In case the second control slot has a negative slope relative to a horizontal line in the upright position of the backrest assembly 1, see second control slot 61" in FIG. 3*c*, the sinusoidal movement of the second sliding means 60' is amplified, whereas a positive slope as depicted as second control slot 61'" in FIG. 3*c* leads to a leveling of the sinusoidal movement of the second sliding means 60'. This is reflected by the three respective curves in FIG. 3*d*, corresponding to the three arrangements of the second control slot 61', 61", 61'" as depicted in FIG. 3*c*. In addition, FIG. 3*d* again depicts the actuator stroke as a function of the recline angle and the cam disk angle as a function of the recline angle.

Accordingly, a backrest assembly of the invention provides a high degree of flexibility due to the fact that the movement of the second sliding means 60, 60' as a function of the actuator stroke can be adjusted to the special needs of a user of a wheelchair provided with said backrest assembly 1.

In order to increase the flexibility a set of rotating means 40, 40' and second sliding means 60, 60' in form of a construction kit can be provided. This enables a selection of the different components of the backrest assembly 1 adapted to the user of the wheelchair.

Figure 4A:
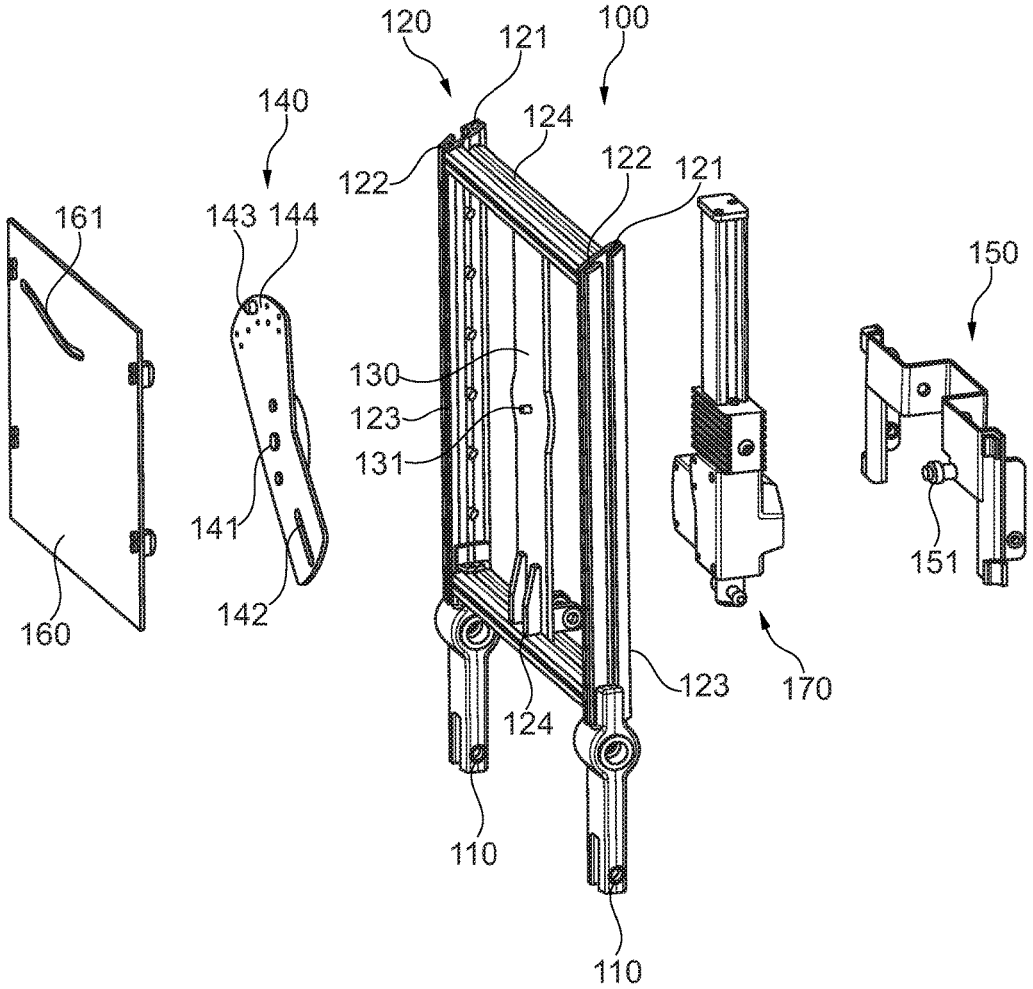
FIG. 4*a* shows an exploded view of the parts of a backrest assembly according to a second embodiment of the invention, from the front side thereof.
Figure 4B:
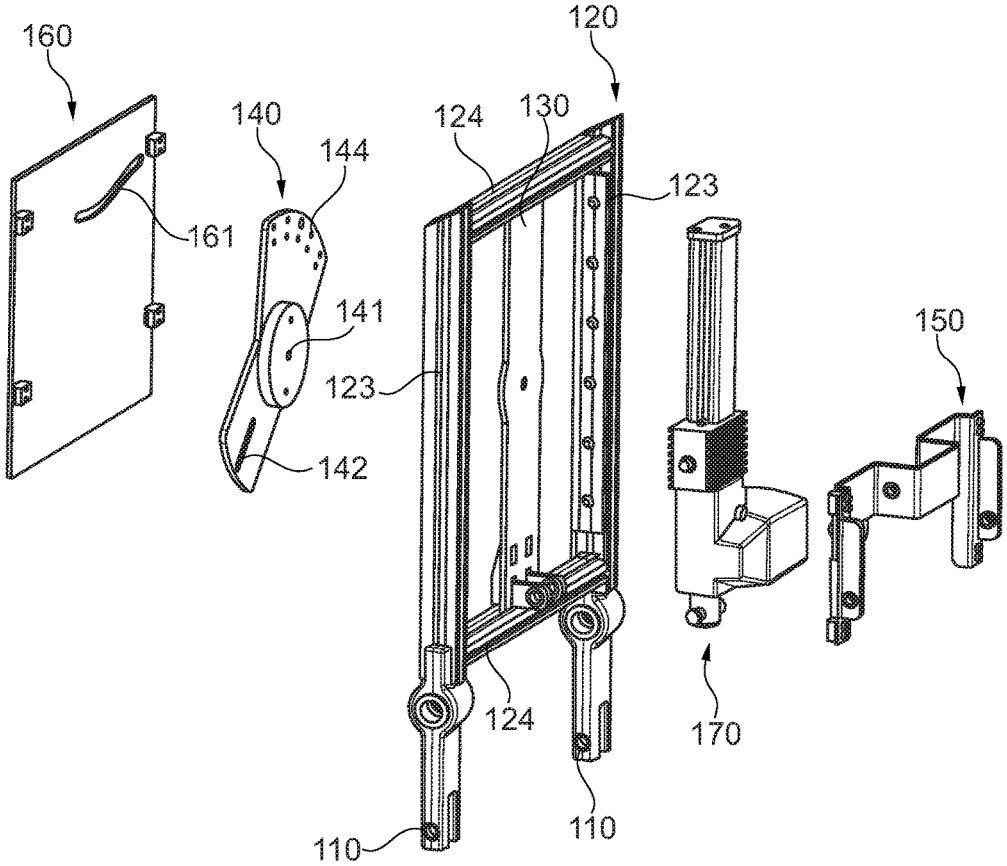
FIG. 4*b* shows an exploded view of the parts of the backrest assembly of FIG. 4*a*, from the rear side thereof.

FIGS. 4*a* and 4*b* refer to a second embodiment of the backrest assembly 100 of the invention. The backrest assembly 100 comprises a backrest frame 120 connected to a seat frame (not shown) in order to be pivotable around a pivot point 110. The backrest frame 120 is provide with first rails 121 and second rails 122 for a slideable attachment of a first sliding means 150 on the rear side thereof and a second sliding means 60 on the front side thereof. The first sliding means 150 is fixed to an actuator 170. The actuator 170 is also carried by a carrying means 130 extending substantially parallel to two parallel first bars 123 of the backrest frame 120 and attached to two parallel second bars 124 of the backrest frame 120, with said second bars 124 running substantially perpendicular to the first bars 123. The carrying means 130 does not extend within the complete space defined by the first and second bars 123 and 124, rather leaves enough space for a first driving cam 151 fixedly secured to the first sliding means 150 to pass there through, in order to slide within a first control slot 142 provided by a rotating means 140 rotably attached to the carrying means 130 via a pivot pin 131 passing through a pivot point 141. The rotating means 140 has the form of a propeller with two blades, the first control slot 142 being provided within one of said blades and the other blade carrying a second driving cam 143. The two blades are arranged substantially opposing each other. The second driving cam 143 is attached to the rotating means 140 at one of a plurality of attachment positions 144. By selecting one of said attachment positions 144 for the attachment of the second driving cam 143 the total stroke as well as the starting point of the sinusoidal movement of the second sliding means 160 is adjustable. The second driving cam 143 passes through a second control slot 161 provided by the second sliding means 160. Said second control slot 161 has a curved shape in order to selectively amplify and/or level the sinusoidal movement of the second sliding means 160 as a function of the recline angle or rather stroke of the actuator 170.

Figure 5A:
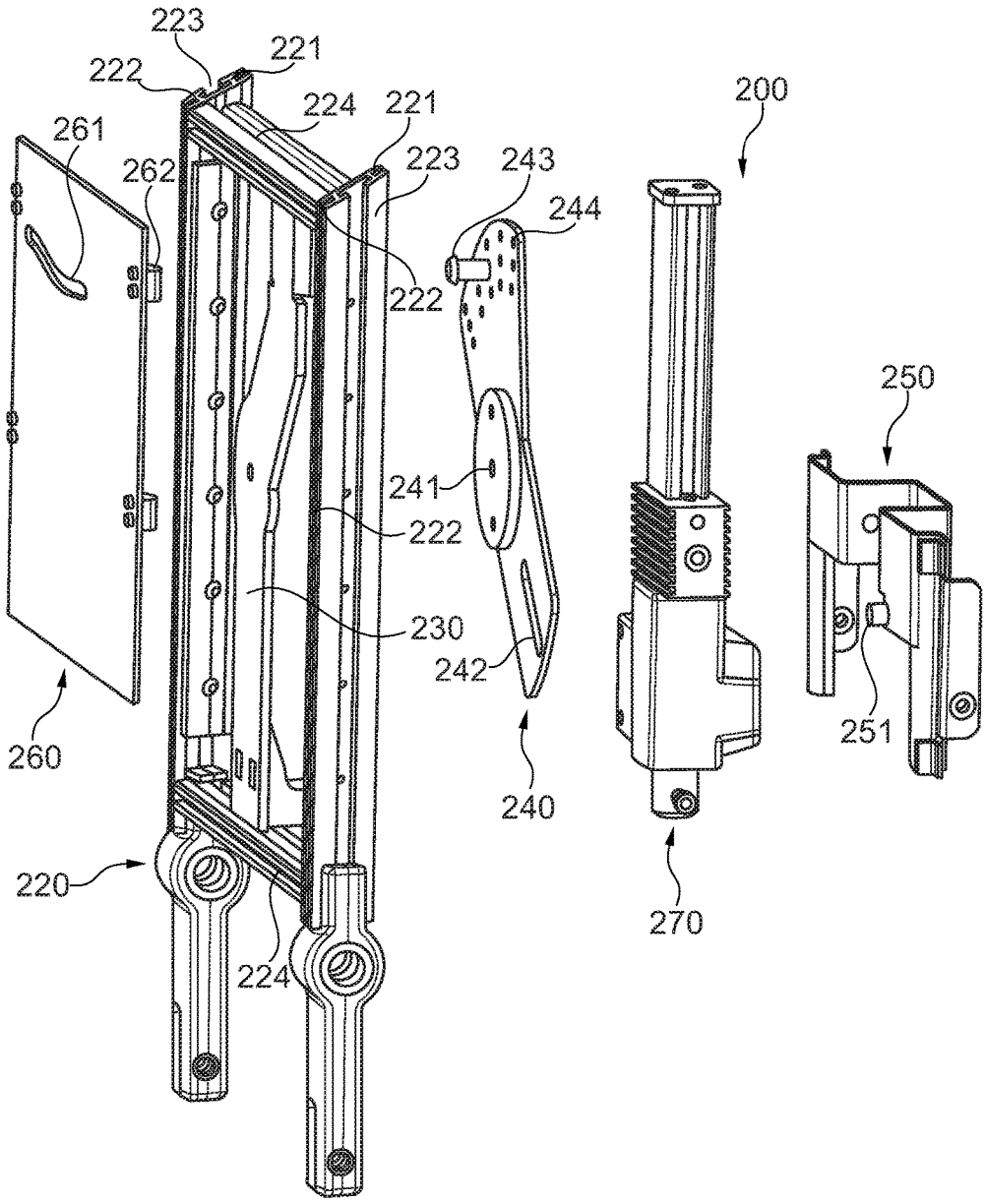
FIG. 5*a* shows an exploded view of the parts of a backrest assembly according to a third embodiment of the invention, from the front side thereof.
Figure 5B:
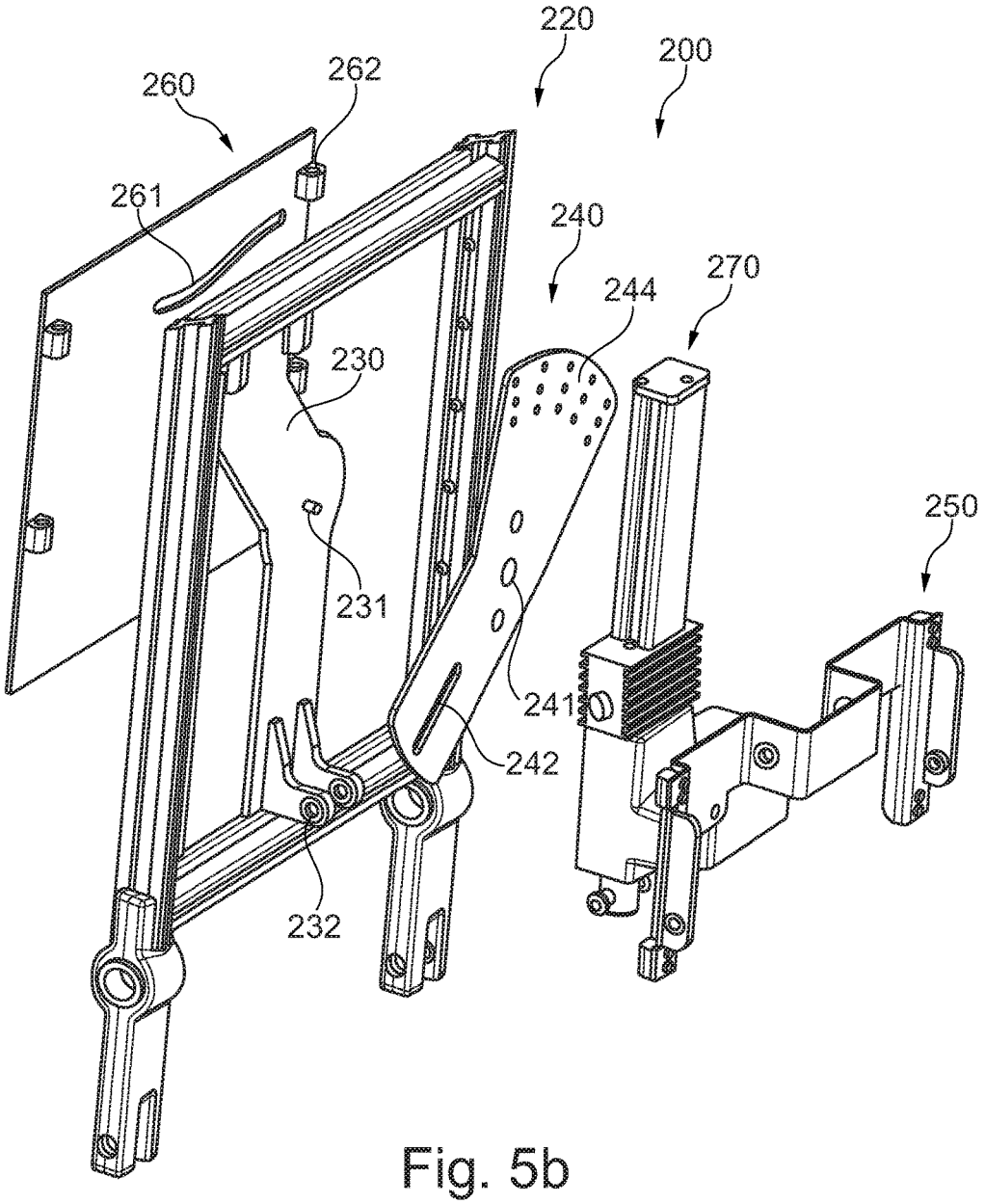
FIG. 5*b* shows an exploded view of the parts of the backrest assembly of FIG. 5*a*, from the rear side thereof.

A backrest assembly 200 according to a third embodiment of the invention is depicted of FIGS. 5*a* and 5*b*. The third embodiment differs from the second embodiment with respect to the arrangement of the rotating means. Whereas the rotating means 140 of the second embodiment is arranged between the carrying means 130 and the second sliding means 160, and thus on the front side of the frame 10, a rotating means 240 of the third embodiment is arranged between a first sliding means 250 and a carrying means 230 and thus on the rear side of a frame 220. The first sliding means 250 is provided with a first driving cam 251 and is securely attached to an actuator 270 which is also attached to the carrying means 230 at attachment points 232, leaving enough space there between for the rotating means 240 attached to the carrying means 230 via a pivot pin 231 at a pivot point 241. The rotating means 240 is provided with a first control slot 242 extending substantially radially and a second driving cam 243 attached to one of a plurality of attachment positions 244. The backrest frame 220 is comprised of first bars 223 and second bars 224, with the first bars 223 carrying first rails 221 on its rear side and second rails 222 on its front side. Within the first rails 221 the first sliding means 250 can slide, whereas within the second rails 222 the second sliding means 260 can slide. The second bars 224 extend between the first bars 223 and carry the carrying means 230 by providing attachment means with the attachment points. The second sliding means 260 is provided with the second control slot 261 having the shape of a curve.

The functioning of the second and third embodiment with respect to the transfer of forces from the actuator 170, 270 to the second sliding means 160, 260 via the first sliding means 150, 250 and the rotating means 140, 240 correspond to that of the first embodiment. In all three cases two links, each in form of a driving cam and at least the control slot within which the driving cam can move, are provided to convert a first sliding movement into a rotational movement and said rotational movement into a second sliding movement such that an actuator stroke is converted into a sinusoidal movement of a second sliding means on which the back of the user rests, either directly or indirectly in case a cushion is provided on the front side of the second sliding means. The important feature of the invention is the adjustability of the sinusoidal movement of the second sliding means 60, 160, 260 via the links. This avoids the application of shear forces to the back of the user during a rotation of the backrest frame 20, 120, 220 relative to the seat frame 10 of a wheelchair in order to switch from a more or less upright seating position of the user to a more or less reclined lying position of the user on the wheelchair.

The principle and mode of operation of this invention have been explained and illustrated in its preferred embodiment. However, it must be understood that this invention may be practiced otherwise than as specifically explained and illustrated without departing from its spirit or scope.

The invention claimed is:

1. A backrest assembly for a wheelchair comprising:

a backrest frame pivotally connected to a seat or seat frame, a carrying means attached to the backrest frame, a rotating means rotatably secured to and supported by the carrier means, a first sliding means slidably connected to the backrest frame on the rear side of the backrest assembly and connected to the rotating means via a first mechanical link, a second sliding means slidably secured to the backrest frame on the front of the backrest assembly and connected to the rotating means via a second mechanical link, and an actuator for adjusting the backrest assembly between an upright and reclined position, with the actuator being connected to the first sliding means for driving the second sliding means via the rotating means to perform a sinusoidal movement.

2. The backrest assembly of claim 1, wherein the first mechanical link comprises a first driving cam sliding within at least one first control slot, and/or wherein the second mechanical link comprises a second driving cam sliding within at least one second control slot.

3. The backrest assembly of claim 2, wherein the first and/or second driving cam is attachable at different positions, and/or the first and/or second control slot has a predefined path, preferably with a slope and/or curvature.

4. The backrest assembly of claim 2, wherein the sinusoidal movement is adjusted or adjustable via the position of the first and/or second driving cam and/or the path of the first and/or second control slot.

5. The backrest assembly of claim 1, wherein the backrest frame comprises at least a first rail for slidable engagement of the first sliding means and at least a second rail for slidable engagement of the second sliding means, and/or the backrest frame comprises two parallel first bars, preferably each being provided with one first and one second rail, in particular by having a T shaped cross section or two opposing recesses at each of two opposite edges, and/or two parallel second bars between the two first bars.

6. The backrest assembly of claim 1, wherein the carrying means is provided within the space defined by the backrest frame, and/or the carrying means is arranged between the two first bars, preferably extending between the two second bars, or the carrying means comprises at least a first rail for slidable engagement of the first sliding means and at least a second rail for slidable engagement of the second sliding means.

7. The backrest assembly of claim 2, wherein the rotating means is arranged on the rear side of the backrest frame, and the rotating means has a first section provided with the first control slot and a second section provided with the second driving cam, preferably the two sections having a relative angular displacement of at least 90°, and/or the rotating means provides the first slot extending substantially radially, and/or the rotating means provides a plurality of positions for the attachment of the second driving cam.

8. The backrest assembly of claim 2, wherein the rotating means is arranged on the front side of the backrest frame, and the carrying means leaves free space relative to the backrest frame or is provided with a first first control slot, preferably the first first control slot extending substantially vertical in the upright position of the backrest assembly, and the rotating means has a first section provided with a first second control slot and a second section provided with the second driving cam, preferably the two sections having a relative angular displacement of at least 90°, and/or the rotating means provides the first second slot extending substantially radially, and/or the rotating means provides a plurality of positions for the attachment of the second driving cam.

9. The backrest assembly of claim 1, wherein the first sliding means houses at least a part of the actuator, and/or the first sliding means moves together with the actuator, and/or the first sliding means is pivotally connected to at least one push rod being fixedly connected to the seat or seat frame, and/or the first sliding means is provided with the first driving cam.

10. The backrest assembly of claim 9, wherein the actuator driving the sliding movement of the first sliding means, which is pivotally connected to the push rod being fixedly connected to the seat or seat frame, causes the reclining movement of the backrest frame relative to the seat or seat frame.

11. The backrest assembly of claim 1, wherein the second sliding means has a plate form, and/or the second sliding means is provided with the second control slot, a second control slot preferably extending parallel to or at least partly sloped and/or curved relative to a horizontal line in the upright position of the backrest assembly, and/or the second sliding means carries at least one cushion and/or accessory on the front of the backrest assembly.

12. The backrest assembly of claim 1, wherein the actuator extends at least partly between the first sliding means and the rotating means or the backrest frame, and/or the actuator comprises a linear drive.

13. The backrest assembly of claim 8, wherein a radial displacement of the second driving cam affects the total stroke applied to the second sliding means, and/or an angular displacement of the second driving cam affects the starting point of the sinusoidal movement of the second sliding means.

14. The backrest assembly of claim 11, wherein a negative slope of the second control slot relative to a horizontal line in the upright position of the backrest assembly amplifies the sinusoidal movement of the second sliding means, and/or a positive slope of the second control slot relative to a horizontal line in the upright position of the backrest assembly levels the sinusoidal movement of the second sliding means.

15. The backrest assembly of claim 1, wherein the rotating means, the first sliding means and/or the second sliding means, preferably the second sliding means, is selectable from a plurality of such means for selecting the movement of the second sliding means during an adjustment of the backrest assembly between the upright and the reclined position.

16. The backrest assembly according to claim 1, the backrest assembly mounted to a wheelchair comprising a seat and at least two drive wheels, the backrest assembly having a recline angle controllable from at least 85° to 180°.

17. A backrest assembly for a wheelchair comprising:

a backrest frame pivotally connected to a seat or seat frame, a carrying means attached to the backrest frame, a rotating means rotatably secured to the carrier means, a first sliding means slidably connected to the backrest frame on the rear side of the backrest assembly and connected to the rotating means via a first mechanical link, a second sliding means slidably secured to the backrest frame on the front of the backrest assembly and connected to the rotating means via a second mechanical link, and an actuator for adjusting the backrest assembly between an upright and reclined position, with the actuator being connected to the first sliding means for driving the second sliding means via the rotating means to perform a sinusoidal movement, wherein the first mechanical link comprises a first driving cam sliding within at least one first control slot, and/or wherein the second mechanical link comprises a second driving cam sliding within at least one second control slot, and the rotating means is arranged on the rear side of the backrest frame and has a first section provided with the first control slot and a second section provided with the second driving cam, the two sections having a relative angular displacement of at least 90°, and/or the rotating means provides the first slot extending substantially radially, and/or the rotating means provides a plurality of positions for the attachment of the second driving cam.

* * * * *